United States Patent [19]

Hirai et al.

[11] Patent Number: 4,529,687

[45] Date of Patent: Jul. 16, 1985

[54] METHOD TO FORM COLOR IMAGE

[75] Inventors: Hiroyuki Hirai; Koichi Nakamura, both of Kanagawa, Japan

[73] Assignee: Fuji Photo Film Co., Ltd., Kanagawa, Japan

[21] Appl. No.: 539,902

[22] Filed: Oct. 7, 1983

[30] Foreign Application Priority Data

Oct. 7, 1982 [JP] Japan ..... 57-175391

[51] Int. Cl.[3] ..... G03C 7/40

[52] U.S. Cl. ..... 430/373; 430/401; 430/943

[58] Field of Search ..... 430/373, 461, 943

[56] References Cited

U.S. PATENT DOCUMENTS 3,253,920 5/1966 Rees et al. ..... 430/470
4,069,050 1/1978 Hara et al. ..... 430/943
4,147,550 4/1979 Campbell et al. ..... 430/529
4,301,236 11/1981 Idota et al. ..... 430/943
4,328,306 5/1982 Idota et al. ..... 430/461
4,414,305 11/1983 Nakamura et al. ..... 430/373

*Primary Examiner*—J. Travis Brown
*Attorney, Agent, or Firm*—Sughrue, Mion, Zinn, Macpeak, and Seas

[57] ABSTRACT

An image forming method to get high density image without any fog is disclosed.

The method is suitable for a low silver containing photographic material. The method include the color developing step with a small amount of monobath developing intensifying solution, wherein the color developing is carried out under the existence of an anion exchanger and/or cationic polymer. The monobath developing intensifying solution may be in contact with the anion exchanger. On the other hand, the cationic polymer may be contained in the photographic material.

4 Claims, No Drawings

METHOD TO FORM COLOR IMAGE

BACKGROUND OF THE INVENTION

1. Field of the Invention

This invention relates to an improved method to obtain color image by a process with a monobath developing intensifying solution. More particularly this invention relates to a method to obtain color image by processing silver halide photographic material having photographic couplers and small content of silver halide—that is low silver containing photographic material—in a monobath developing intensifying solution containing both $H_2O_2$ or compounds which can release $H_2O_2$ and a color developing agent.

2. Description of the Prior Art

It is well known that there are many methods to intensify a image by processing with some reagents, after a development of silver halide photosensitive material.

It is described, for example, in the "History of Color Photography" 2nd Ed. 406p (1956), written by Friedman, that in the presence of a coupler, a paraphenylenediamine color developing agent is oxidized by the decomposition of $H_2O_2$ on the surface of a catalyst followed by coupling reaction of said oxidized agent with the coupler to form a dye. And, other photographic methods utilizing the decomposition of $H_2O_2$ on the surface of noble metals are described in applications in West Germany (OLS) Nos. 1,813,920, 1,950,102, 1,961,029, 2,044,833, 2,044,993, 2,056,360, 2,056,359 and 2,120,091 respectively.

On the otherhand, color intensifying methods employing cobalt complex salt on the surface of noble metals are described, in several issues of the Japanese Patent Gazette under Provisional Publication Nos. 9,728/73, 9,729/73, 48,130/73, 84,229/74, 84,240/74, 97,614/74, 102,340/74 and 102,314/74, which laid "open to public inspection" (hereinafter "Japanese Patent Application—OPI" in this description).

The methods of color intensification using halogenous acids, such as chlorous acid are described in Japanese Patent Application—OPI Nos. 53,826/76 and 13,335/77. A color intensifying method with iodoso compounds, such as iodosobenzoic acid, is mentioned in Japanese Patent Application—OPI No. 73,731/77.

These compounds such as peroxides, halogenous acids, iodoso compounds and cobalt complex salts (III), which have an intensifying effect, are called intensifying agents and the treating bath which includes intensifying agent is called as intensifying bath.

Image intensifying techniques using peroxides or cobalt (III) complex salts as catalysts are especially well known as typical techniques for image intensification. It is considered that the intensification with peroxide gives the largest amplification factor.

Above described methods are known as ways to intensify an image with an oxidation product of a color developing agent. The oxidation product of a color developing agent is produced by a redox reaction between an intensifying agent and a color developing agent, then it forms color images of high density. The redox reaction occurs on a developed silver specks (a catalyst of this reaction) which have grown from the latent image specks which are formed by an imagewise exposure on a silver halide photographic material.

In other words, the intensifying process is comprised of several processes. For example, one process is to dip color photographic materials in a intensifying bath after color development. Another process is to dip color photographic materials which have been developed with a black and white developing solution into a color developing solution, and then dip into an intensifying bath. This total process is comprised of (1) a procedure to improve latent image by development and (2) a procedure to intensify image in a intensifying bath utilizing redox reactions on developed silver specks which occur between intensifying agents and color developers which had been retained in layers of photographic film.

All of these procedures are generally known as intensifying process.

Therefore, in order to intensify an image with high efficiency, a large amount of developing agent should be retained in a layer of the photographic material. Moreover, before the developing agent diffuses into the intensifying bath it should be quickly oxidized by the intensifying agent (in this oxdization the silver speck acts as a catalyst).

In this point of view, specific methods employing developing agents having large oilphilicity into developing solution were disclosed in U.S. Pat. No. 3,816,134 and in Japanese Patent Application—OPI No. 30,333/78.

The fog which may be formed in the intensification process can be suppressed, without degrading the activity of catalytic specks, using techniques which were disclosed in Japanese Patent Application—OPI Nos. 13,335/77 and 19,829/78.

As above described, many techniques in relation to the intensifying process have been developed. The intensification method, however, may not be desirable because the processing steps can not be simplified as compared to the presently existing methods. In intensification process increases the processing steps because of the intensifying bath; thereby spoiling the simplicity of the total process. The simplification of the steps was disclosed in U.S. Pat. Nos. 3,847,619 and 3,923,511. These patents disclose that the development process, the intensification process and the bleaching process may be carried out in a monobath with cobalt (III) complex. However, it is difficult to obtain excellent color image in cases in which a low silver containing photographic material is processed in a monobath developing intensifying solution containing cobalt (III) complex. In this process the result is that fog is caused by the intensification and the image is of low density.

Furthermore, it is mentioned in West Germany Patent No. 1,813,920 and in Japanese Patent Application—OPI Nos. 13,335/77, 127,555/80 etc., that it is possible to make both development and intensification in one bath containing $H_2O_2$ which results in a large amplifying efficiency. However, when a low silver containing photographic material is used, even if $H_2O_2$ is added into a conventional color developing solution, KBr (usually several hundreds mg/l of KBr is added in the color developer) existing in the color developing solution spoils the image and the expected effect from the monobath developing intensifying process can not be obtained.

The method to solve these problems existing in a conventional processes is given in Japanese Patent Application No. 117,973/81 (which is laid open; Japanese Patent Application—OPI No. 18,629/83). That method, with small numbers of processing step, can intensify the image without fog and give a large amplification efficiency even if a low silver containing color photographic material is used. In more detail, that invention is the method to form color images by processing imagewisely irradiated photographic material under the existence of compounds which can react with or adsorb on silver halide, using monobath developing intensifying solution which contains neither $Br^-$ nor $I^-$ substantially but contains both $H_2O_2$ or chemicals which can release $H_2O_2$ and color developing agents.

In that process, the quantity of the color developing agent to be added is at least $10^{-3}$ mole/l and preferably $2\times10^{-3}\sim10^{-1}$ mole/l, and the quantity of $H_2O_2$ against the color developing agent is $0.5\sim200$ (mole/mole) and preferably $1\sim80$ (mole/mole), in addition, it is preferable that $Br^-$ and $I^-$ are not contained, however, they may be present in an amount such as $2\times10^{-4}$ mole/l.

Although the above process has the effect of saving large amounts of silver, that technique is not sufficient in following points: first, the monobath developing intensifying solution is not stable and has a limited shelf life. Moreover it is impossible to reproduce good images when only a small amount of the solution is replenished. The conventional color developing process does not have this defect; secondary, if a large amount of the solution is replenished to get a sufficiently reproduced image, total cost will increase; for example, because of the expense incurred in resulting the waste solution.

Those problems are not solved by the process which abandons the treating solution every time. Because, that process results in a decrease of quantity of the developing intensifying solution per unit area of photosensitive material to be developed, that is, after a little increase of halogen ions such as $Br^-$ and $I^-$, which have dissolved from the photosensitive material into the developing intensifying solution, the solution is spoiled markedly and image with only low density can be obtained.

On the other hand, it is known that a spoiled color developer can be refreshed by contacting it to anion exchanger as disclosed, for example, in West Germany Patent No. 2,717,674, U.S. Pat. No. 3,253,920, Japanese Patent Application—OPI Nos. 37,731/79 and 1,048/81 etc. But in that case, as the quantity of halide ions (especially $Br^-$ and $I^-$) in the color developer is required to be constant, though it is troublesome, some technique should be introduced to control the concentration of halide ions.

In a known process to reproduce spoiled color developer using anion exchanger, products of oxidized developing agents accumulate in the color developer. In this case ion exchange ability of said anion exchanger is remarkably damaged even when a small amount of spoiled color developer is passed through it. So, above mentioned techniques have the deficiency that said spoiled color developer should be in contact with absorbents, before it is in contact with anion exchanger (Japanese Patent Application—OPI No. 132,343/78 etc.).

SUMMARY OF THE INVENTION

It is accordingly a general object of the invention to provide high density color photographic images by repressing bad effects resulting from the diffusion of halide ions retained in a low silver containing photographic material into a developer.

It is a more specific object of the invention to provide a method to obtain good reproduced color images quickly using a small amount of developing intensifying solution.

It is a further object of the invention to provide a treating method for color development using a small amount of monobath developing intensifying solution containing both $H_2O_2$ or compounds which can release $H_2O_2$ and color developing agents.

It is a still further object of the invention to provide a color developing method for low silver containing photographic material, in which life time of an anion exchanger employed to remove $Br^-$ and $I^-$ from the monobath developing intensifying solution is very long.

An advantage of the invention is that it provides a monobath developing intensifying process to get excellent color image easily, having both high density and good reproducibility even when a low silver containing photographic material is developed with a small amount of monobath developing intensifying solution.

Briefly, the invention is the method to form color image which uses a low silver containing photographic material, in which the photographic material is developed under the existence of nitrogen-containing heterocyclic compounds using monobath developing intensifying solution, which contains substantially neither $Br^-$ nor $I^-$, but contains both $H_2O_2$ or compounds which can release $H_2O_2$ and color developing agents; the color development improves when it is treated under the existence of anion exchangers and/or cationic polymers to capture $Br^-$ and $I^-$.

DESCRIPTION OF THE PREFERRED EMBODIMENTS

Nitrogen-containing heterocyclic compounds (hereinafter "N-containing heterocyclic compounds") used in present invention can repress the fog of got image, and one of them alone or some combinations of them can be introduced in a halide silver photosensitive material and/or in a developing intensifying solution.

In present invention, N-containing 5 membered or 6 membered heterocyclic compounds, condensed rings thereof and N-containing heteroocyclic compounds represented by following general formulae (I) and (II) are preferable as above described compounds.

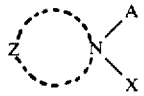

General formula [I]

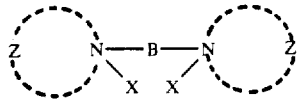

General formula [II]

In general formulae (I) and (II), A is a substituted or a nonsubstituted alkyl group, an alkenyl group, an alkynyl group, an aralkyl group, an alicyclic hydrocarbon group, a substituted or a nonsubstituted aryl group; B is a substituted or a nonsubstituted divalent hydrocarbon group. For example, the following divalent groups are preferable.

$-(CH_2)_n-$, $-CH_2O-(CH_2)_n-O-CH_2-$.

-continued

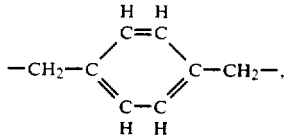

$-CH_2-O-CH_2-$, n represents an integer of 1 to 12. X represents an anion except $I^-$ ion. Z represents a nonmetallic group which forms a heterocyclic ring with a N atom.

The more clarified examples of N-containing heterocyclic compounds which can be used in this invention are illustrated below.

General formula (III)

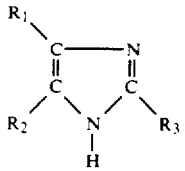

General formula (IV)

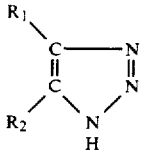

General formula (V)

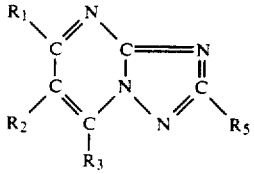

General formula (VI)

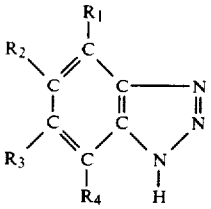

General formula (VII)

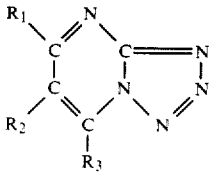

General formula (VIII)

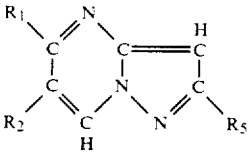

-continued

General formula (IX)

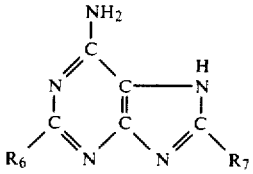

General formula (X)

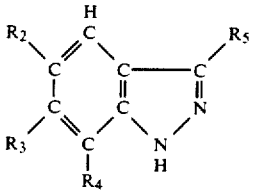

General formula (XI)

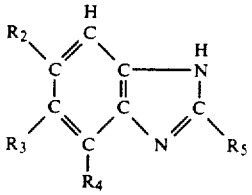

General formula (XII)

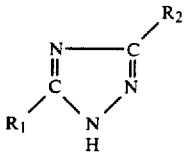

General formula (XIII)

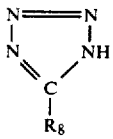

General formula (XIV)

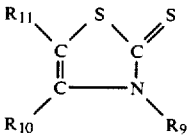

In the general formulae (III) to (XIV), $R_1$, $R_2$, $R_3$ and $R_4$ each represent a hydrogen atom, an alkyl group, an aralkyl group, an alkenyl group, an alkoxy group, an aryl group, —NRR′, —COOR, $-SO_3M$, —CONRR′, $-NHSO_2R$, $-SO_2NRR'$, $-NO_2$, a halogen atom, —CN or —OH group (R and R′ each represents a hydrogen atom, an alkyl group, an aryl group or an aralkyl group, M represents a hydrogen atom, or an alkalimetal atom.). When $R_1$ and $R_2$ each is an alkyl group, both may be bonded with each other to form an aliphatic carbon ring.

$R_5$ represents a hydrogen atom, an alkyl group having from 1 to 5 carbon atoms or —S—R″ group (R″ is a hydrogen atom, an alkyl group, an aryl group or an aralkyl group.). $R_6$ is a hydrogen atom or an alkyl group.

$R_7$ is a hydrogen atom, an alkyl group or an aryl group. $R_8$ represents an alkyl group, an aryl group, a benzyl group or a pyridyl group. $R_9$ represents an alkyl group, an alkenyl group or an aryl group. $R_{10}$ and $R_{11}$ represent an alkyl group, an alkenyl group or an aryl group. When $R_{10}$ and $R_{11}$ are an alkyl group, both may be bonded with each other to form an aromatic ring.

As a N-containing heterocyclic compound having a mercapto group, compounds represented by the following general formula are preferable.

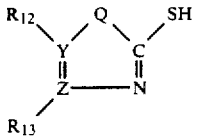

General formula (XV)

In the general formula (XV), Q represents an oxygen atom, a sulfur atom or —NR''' group (R''' is a hydrogen atom, an alkyl group, an unsaturated alkyl group, or a substituted or a nonsubstituted aryl or aralkyl group.). Both Y and Z are either a carbon atom or a nitrogen atom, $R_{12}$ and $R_{13}$ each represents a hydrogen atom, an alkyl group, an unsaturated alkyl group, a substituted or a nonsubstituted aryl group, or a substituted or a nonsubstituted aralkyl group, —SR'''' and —$NH_2$ group (R'''' is a hydrogen atom, an alkyl group, an aryl group, an aralkyl group, an alkylcarboxylic acid or an alkali metal salt thereof, an alkylsulfonic acid or an alkali salt thereof), and when both of Y and Z are carbon atoms, $R_{12}$ and $R_{13}$ may form a substituted or a nonsubstituted aromatic ring.

Typical examples of N-containing heterocyclic compounds which can be used in this invention are shown below.

(1)

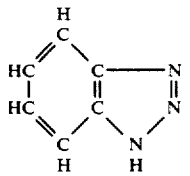

(2)

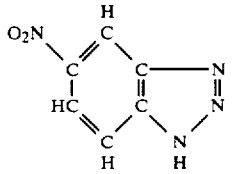

(3)

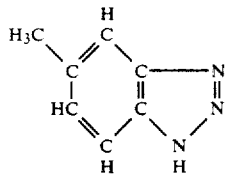

-continued (4)

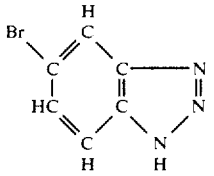

(5)

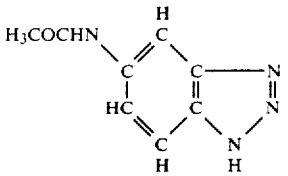

(6)

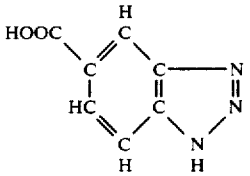

(7)

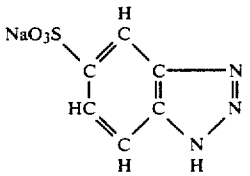

(8)

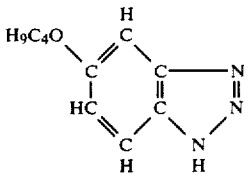

(9)

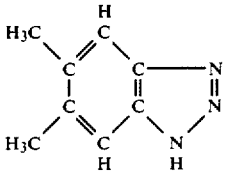

(10)

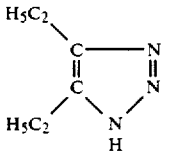

(11)

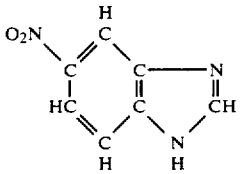

(12)

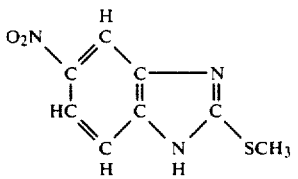

-continued
(13)
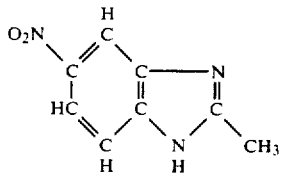
(14)
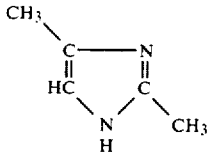
(15)
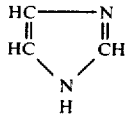
(16)
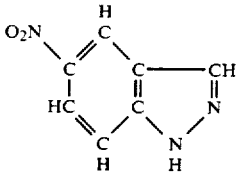
(17)
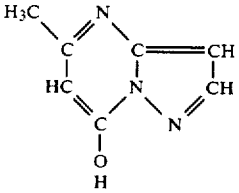
(18)
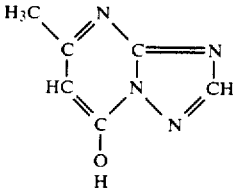
(19)
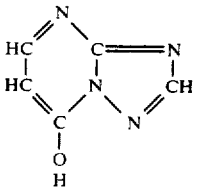
(20)
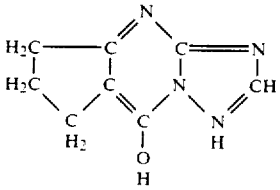
-continued
(21)
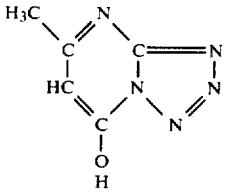
(22)
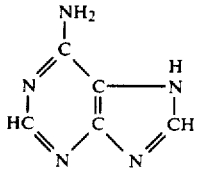
(23)
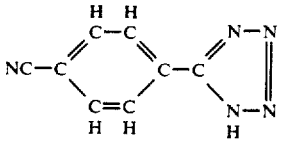
(24)
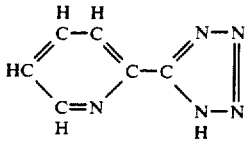
(25)
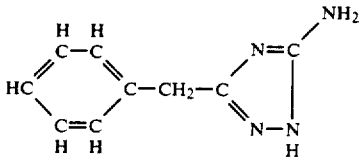
(26)
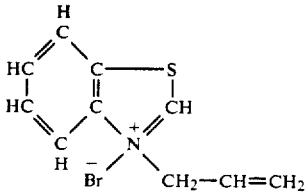
(27)
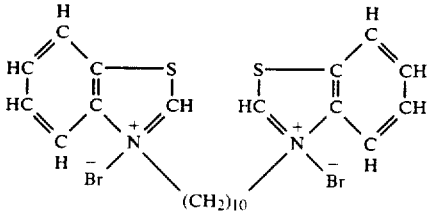
(28)
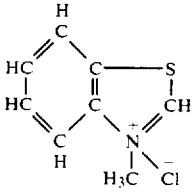

-continued
(29)
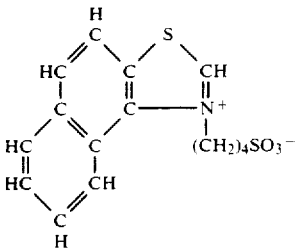
(30)
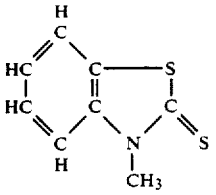
(31)
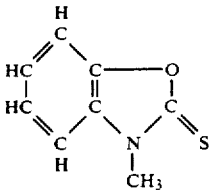
(32)
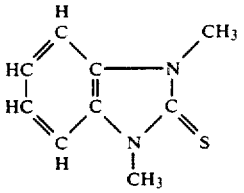
(33)
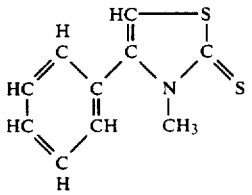
(34)
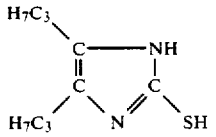
(35)
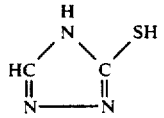
(36)
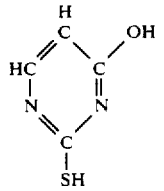
(37)
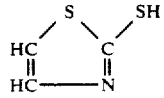
-continued
(38)
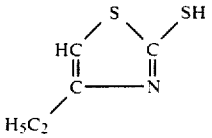
(39)
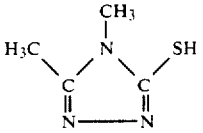
(40)
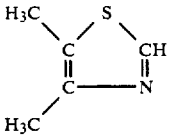
(41)
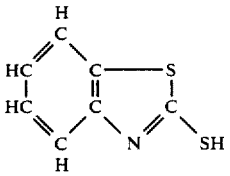
(42)
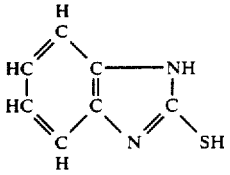
(43)
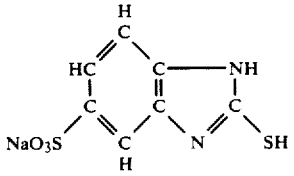
(44)
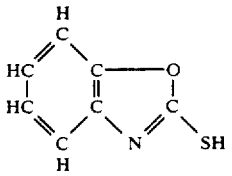
(45)
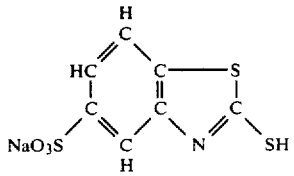
(46)
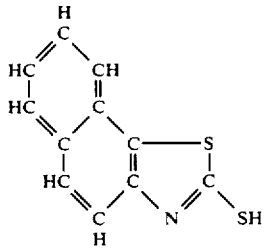

-continued (47)

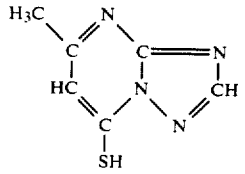

(48)

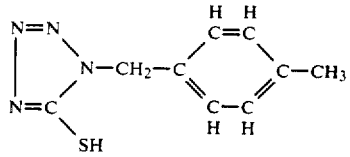

(49)

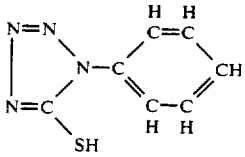

(50)

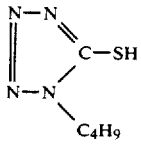

(51)

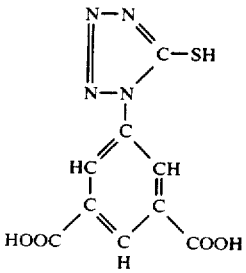

(52)

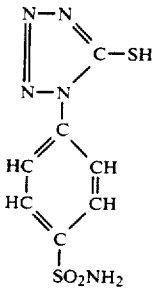

(53)

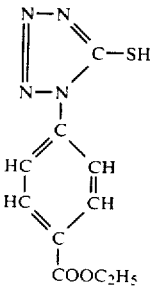

-continued (54)

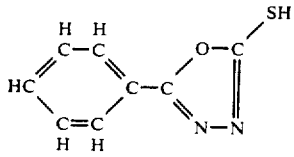

(55)

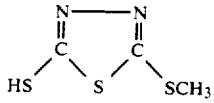

(56)

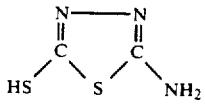

(57)

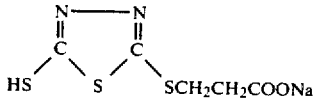

(58)

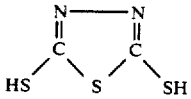

Although, as mentioned previously, these N-containing heterocyclic compounds having anti-fogging effect can be employed in a photographic material and/or in a monobath developing intensifying solution, when they are employed in the monobath developing intensifying solution, they are adsorbed on an anion exchanger which is utilized to remove halogen ions existing in the solution and fogs increase.

Thus, in the process where the monobath developing intensifying solution contacts with an ion exchanger, it is preferable to retain N-containing heterocyclic compounds in the photographic material.

The amount of N-containing heterocyclic compounds to be added into photographic material is not specifically limited, because it depends on a species of silver halide which is used in the low silver containing photographic material, and depends both on the amount of silver to be coated and a species of the compound having the above mentioned anti-fogging effect. However, the amount to be added is preferably from $10^{-8}$ mole to $10^{-2}$ mole per $m^2$ of the photographic material and more particularly $10^{-7}$ mole/$m^2$ ~ $10^{-3}$ mole/$m^2$. In this case the above mentioned N-containing heterocyclic compound is not necessarily added in a monobath developing intensifying solution, but it may be contained about $10^{-4}$ mole/l.

Moreover, N-containing heterocyclic compounds such as those used in the following prior works can also be employed in this invention: nitrobenzimidazole as described in U.S. Pat. Nos. 2,496,940, 2,497,917 and 2,656,271, and in British Pat. No. 403,789, benztriazoles as described in "Nippon Shashin Gakkaishi", Vol. 11, page 48 (1948), quaternary heterocyclic salts such as benzthiazolium salt which is described in U.S. Pat. Nos. 2,131,038, 2,694,716, and 3,326,681, tetrazaindenes as described in U.S. Pat. Nos. 2,444,605, 2,444,606, 2,444,607, heterocyclic compounds described in U.S. Pat. Nos. 2,173,628, 2,324,123 and 2,444,608 and compounds described in "Kagaku Shashin Binran" middle vol., page 119 (published by Maruzen in 1959).

The shape of the anion exchanger is not definitly limited and any shape, such as a granular, a textural, a menbranous, a tube like or a pellet like shape, may be chosen in this invention.

Anion exchangers which can be used in this invention may be selected from plastics such as an anion exchange resin, an anion exchange menbrane and adsorption resin; however, anion exchange resins can completely remove $Br^-$ and $I^-$ in a short time, thus it is preferable to use them.

Some examples of the above mentioned ion exchange resins are as follows: a strong base type of polystyrene series, a weak base type of polystyrene series, a weak base type of polyacryl series, a weak base type of phenol series and a medium base type of epoxy polyamine series. However, it is preferable to utilize the strong base type—especially, anion exchange resins having a dimethylethanol ammonium group or a trimethyl ammonium group as an active ion exchange group.

These anion exchange resins are founded on polystyrene or on polystyrene-divinyl benzene copolymer. For example, these anion exchange resins are described in U.S. Pat. No. 3,253,920 and West Germany Pat. No. 1,054,715 etc.

Anion exchange resins can be utilized in the same Cl type or OH type as they were sold commercially, but also they may be utilized in another type, such as $SO_4$ type, $CO_3$ type or $PO_4$ type, after some pretreatment.

A form utilizing anion exchanger is never restricted but it is sufficient if the developing intensifying solution can substantially contact an anion exchanger. An anion exchanger may be put in a processing bath flatly or in a column. On the otherhand, a developing intensifying solution may be circulated between a processing bath and a column, which is packed with an anion exchanger in it.

The amount of ion exchanger that is used in this invention depends on the ion exchange ability of the ion exchanger against halide ions. It also depends on the amount of silver halide which is introduced into the photographic material and depends on the amount of developing intensifying solution which will be used per unit area of the photographic material. The preferable amount is 1 g ~500 g of ion exchanger per 1 l of the developing intensifying solution.

Some of cationic polymers which can be used in this invention are, a polymer which has a secondary or a tertiary amino group, a polymer which has a N-containing heterocyclic compound and a polymer having quaternary cationic group thereof. Molecular weight of these polymers can be 5,000~1,000,000 and is preferably 10,000~200,000.

These cationic polymers can be chosen arbitrary from those which are already known. For example, the following polymers can be used: polymers made from vinylpyridine and cationic polymers having vinylpyridinume cation which are disclosed in U.S. Pat. Nos. 2,548,564, 2,484,430, 3,148,061, 3,756,814; vinylimidazolium cationic polymers which are disclosed in U.S. Pat. No. 4,124,386; polymer mordants which can form bridges with gelatin and with others. Some of these mordants are as follows: mordants disclosed in U.S. Pat. Nos. 3,625,694, 3,859,096, 4,128,538 and in British Pat. No. 1,277,453; mordants of aqueous Sols which are disclosed in U.S. Pat. Nos. 3,958,995, 2,721,852, 2,798,063 and in Japanese Patent Application—OPI Nos. 115,228/79, 145,529/79, 126,027/79, 155,835/79, 17,352/81; mordants which are not soluble in water as disclosed in U.S. Pat. No. 3,898,088 etc.; mordants which are disclosed in prior arts such as U.S. Pat. Nos. 3,709,690, 3,788,855, 3,642,482, 3,488,706, 3,557,066, 3,271,147, 3,271,148, Japanese Patent Application—OPI Nos. 30,328/78, 155,528/77, 125/78, 1,024/78, 107,835/78 and British Pat. No. 2,064,802; and other mordants disclosed in U.S. Pat. Nos. 2,675,316 and 2,882,156 etc.

In these cationic polymers, those which hardly move from the layer, in which they were retained, to other layers of the photographic material are preferable; some examples are polymers which can react with matrixes (such as gelatin) and form bridges, cationic polymers which are not soluble in water and polymers of aqueous Sol (or latex—dispersion).

The most preferable cationic polymers are shown below.

(i) A polymer shown by the following general formula (1)

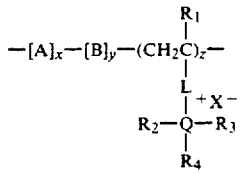

general formula [1]

In the general formula (1), [A] is a monomer unit which is derived from monomers having at least two ethylenic unsuturated groups which are able to copolymerize. [B] is a monomer unit which is derived from monomers which are able to copolymerize with both monomers which give an [A] component and a z component respectively. $R_1$ represents a hydrogen atom or a lower alkyl group which has about 1~6 carbon atoms. L represents a divalent group which has about 1~12 carbon atoms. $R_2$, $R_3$ and $R_4$ each represent an alkyl group which has about 1~20 carbon atoms (each alkyl group may be the same or not the same), or also represent an aralkyl group which has about 7-20 carbon atoms. $R_2$, $R_3$ and $R_4$ may be bonded with each other to form a cyclic structure with Q. Q represents either a nitrogen atom or a phosphorus atom. $X^-$ represents any anions other than $Br^-$ and $I^-$. x is about 0.2~15 mole%, y is 0~ about 90 mole% and z is about 5~99 mole %.

Above described monomers, which can derive monomer unit of [A] in the general formula (1), preferably have 2~4 ethylenic unsaturated groups. Some of these monomers are, esters, amides, olefines and aryl compounds.

Some copolymerizable monomers which have at least two ethylenic unsaturated groups are as follows: ethylene glycol dimethacrylate, diethylene glycol dimethacrylate, neopentyl glycol dimethacrylate, tetramethylene glycol dimethacrylate, pentaerithritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allyl methacrylate, allyl acrylate, diallyl phthalate, methylene bisacrylamide, methylene bismethacrylamide, trivinyl cyclohexane, divinyl benzene, N,N-bis(vinyl benzil)-N,N-dimethyl ammonium chloride, N,N-diethyl-N-(methacryloil oxyethyl)-N-(vinyl benzil)-ammonium chloride, N,N,N',N'-tetraethyl-N,N'-bis(vinyl benzil)-p-xylylene diammonium dichloride, N,N'-bis(vinyl benzil)-triehylene diammonium dichloride and N,N,N',N'-tetrabutyl-N,N'-bis(vinyl benzil)-ethylene diammonium dichloride. In these monomers divinylbenzene trivinylcyclohexane is most preferable, because it has excellent properties such as hydrophobicity and alkali resistance. [A] may contain more than two species of the above described monomers.

[B] represents a monomer unit which is derived from ethylenic unsaturated monomers which can be copolymerize with both [A] and z components. Some of these ethylenic unsaturated monomers are olefins (e.g., ethylene, propylene, 1-butene, vinylchloride, vinylidene chloride, isobutene, vinylbromide), dienes (e.g., butadiene, isoprene, chloroprene), ethylenic unsaturated esters of fatty acids or of aromatic carboxylic acids (e.g., vinylacetate, allylacetate, vinylpropionate, vinylbutylate, binylbenzoic acid), esters of ethylenic unsaturated acid (e.g., methyl methacrylate, butyl methacrylate, t-butyl methacrylate, cyclohexyl methacrylate, benzil methacrylate, phenyl methacrylate, octyl methacrylate, amyl acrylate, 2-ethyl hexyl acrylate, benzil acrylate, maleic acid dibutyl ester, fumaric acid diethyl ester, crotonic acid ethyl ester, methylene malonic acid dibutyl ester), styrenes (e.g., styrene, α-methyl styrene, vinyl toluene, chloro methyl styrene, chloro styrene, dichloro styrene, bromo styrene), and unsaturated nitryls, (e.g., acrylonitrile, methacrylonitrile, allyl cyanide, croton nitryl). [B] may contain more than two of these monomers. Considering properties such as emulsion polymerization and hydrophobicity when a cationic polymer is introduced into photographic material, it is preferable to use monomers such as styrenes and methacrylates.

In the general formula (I), $R_1$ represents a hydrogen atom or a lower alkyl group having about 1~6 carbon atoms. Preferably, $R_1$ is a hydrogen atom or a methyl group, because polymerization reaction which is carried out in that case is suitable.

L represents a divalent group which has carbon atoms of 1 to about 12.

The following groups are preferable for L:

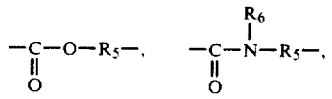

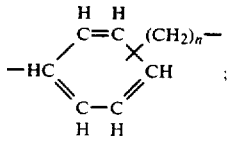

more preferably L is

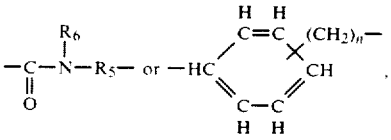

most preferably L is

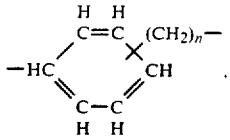

because it is suitable both for emulsion polymerization and for mordant property.

In these formulae, $R_5$ represents an alkylene group (e.g., methylene, ethylene, trimethylene and tetramethylene), an arylene group and an aralkylene group (e.g.,

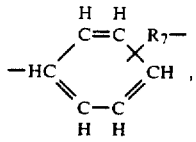

in this case $R_7$ is an alkylene group having 0~about 6 carbon atoms).

$R_5$ is a hydrogen atom or $R_2$. n is a integer of 1 or 2.

In the general formula (1), Q represents a nitrogen atom or a phosphorus atom. Since, the nitrogen atom is not poisonous it is more preferable.

$X^-$ is an anion except $Br^-$ and $I^-$. For example, $X^-$ represents $Cl^-$ ion, an alkyl sulfuric ion (e.g., methyl sulfuric ion, ethyl sulfuric ion), ions of an alkyl sulfonic or an aryl sulfonic acid (e.g., methane sulfonic acid, ethane sulfonic acid, benzene sulfonic acid, p-toluen sulfonic acid), or ions of acetic acid and sulfuric acid. In these ions, the chlorine ion, the ions of an alkyl sulfuric acid and of an aryl sulfonic acid are preferable.

In the general formula (1), $R_2$, $R_3$ and $R_4$ may represent the same or a different alkyl group having 1 to about 20 carbon atoms, or they may represent the same or a different aralkyl group having about 7 to 20 carbon atoms. These alkyl groups and aralkyl groups include both substituted alkyl groups and substituted aralkyl groups. $R_2$, $R_3$ and $R_4$ may be bonded to each other to form a ring structure with Q. Therefore these alkyl groups are nonsubstituted alkyl groups (e.g., methyl, ethyl, propyl, isopropyl, t-butyl, hexyl, cyclohexyl, 2-ethylhexyl, dodecil) and substituted alkyl groups, such as an alkoxyalkyl group (e.g., methoxymethyl, methoxybutyl, ethoxyethyl, butoxyethyl, vinyloxyethyl), a cyanoalkyl group (e.g., 2-cyanoethyl, 3-cyanopropyl), an alkyl halide group (e.g., 2-fluoroethyl, 2-chloroethyl, perchloropropyl), an alkoxycarbonylalkyl group (e.g., ethoxycarbonyl methyl), an allyl group, a 2-butenyl group and a propagyl group. Aralkyl groups are a nonsubstitutedaralkyl group (e.g., benzyl, phenethyl, diphenylmethyl, naphthylmethyl) and a substituted aralkyl group, such as an alkyl aralkyl group (e.g., 4-methylbenzyl, 2,5-dimethylbenzyl, 4-isopropylbenzyl, 4-octhylbenzyl), an alkoxyaralkyl group (e.g., 4-methoxybenzyl, 4-pentachloropropenyloxybenzyl, 4-ethoxybenzyl), a cyano aralkyl group (e.g., 4-cyanobenzyl, 4-(4-cyanophenyl)benzyl), an aralkyl halide group (e.g., 4-chlorobenzyl, 3-chlorobenzyl, 4-bromobenzyl, 4-(4-chlorophenyl)benzyl).

It is preferable that the above described alkyl groups contain 1~12 carbon atoms; however in the case of the above described aralkyl groups, 7~14 carbon atoms are suitable.

Several examples in which $R_2$, $R_3$ and $R_4$ bond together to form a ring structure with Q, are shown below.

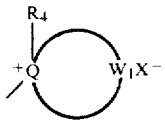

(a)

In this general formula, $W_1$ represents atomic groups that are necessary to form an aliphatic heterocyclic ring with Q. Some examples of aliphatic heterocyclic rings are as follows.

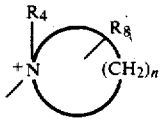

①

$R_8$ represents a hydrogen atom or $R_4$. n is an integer between 2 and 12.

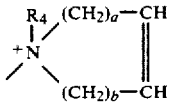

②

In this diagram, a and b are integers which can satisfy the next relation; $a+b=2\sim7$.

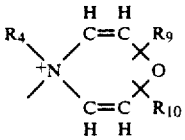

③

$R_9$ and $R_{10}$ each represent a hydrogen atom or a lower alkyl group having 1 to 6 carbon atoms.

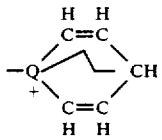

④

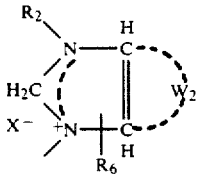

(b)

In this diagram, $W_2$ (which represents atomic groups to form benzen ring) is not always necessary.

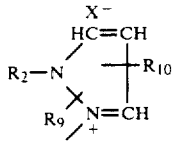

(c)

-continued

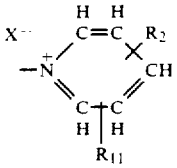

(d)

$R_{11}$ represents a hydrogen atom, $R_2$, or the following groups,

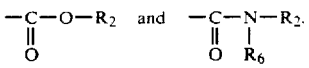

In the above examples, $R_2$, $R_4$, $R_6$, Q and $X^-$ are the same as those of the general formula (1). In these ring structures, the structures represented in ① of (a) and in (b) are preferable. The most preferable structures are:

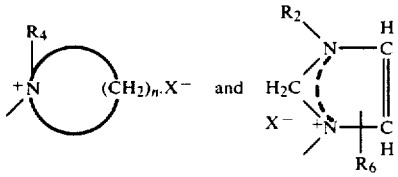

(n = integers of 4 to 6)

In the general formula (1), the z component may be not only single but also mixtures of more than two species. x is about $0.2\sim15$ mole%, and the most preferable range is between 1.0 and 10 mole%. y is $0\sim90$ mole%, and the most preferable range is between 20 and 60 mole%. z can be $5\sim99$ mole%, preferably $20\sim80$ mole% is better and $30\sim70$ mole% is the best.

(ii) Water insoluble polymers, more than $\frac{1}{3}$ of which consists of the following repeating unit,

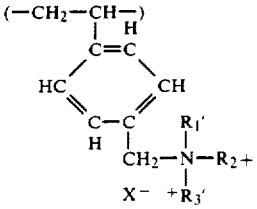

are also preferable cationic polymers.

In this diagram $R_1'$, $R_2'$ and $R_3'$ each represent an alkyl group; moreover, the total carbon number of $R_1'\sim R_3'$ is a number larger than 12. At least two groups among $R_1'\sim R_3'$ may bond with each other. In this case these groups and rings may be substituted in some ways. $X^-$ is the same as $X^-$ in the general formula (1). Namely this $X^-$ represents any anions other than $Br^-$ and $I^-$ ions.

For the synthesis of a cationic polymer which is used in this invention, the following works are useful: Japanese patent publication No. 29,195/72, Japanese Patent Application-OPI Nos. 37,488/73, 76,593/73, 92,022/73, 21,134/74, 120,634/74, 72,622/78, British Pat. Nos. 1,211,039, 961,395, U.S. Pat. Nos. 2,795,564, 2,914,499, 3,033,833, 3,547,899, 3,227,672, 3,290,417, 3,262,919, 3,245,932, 2,681,897, 3,230,275, Canadian Patent No. 704,778, John C. Petropoulos et al.; Official Digest 33 719~736 (1961), Sadao Hayashi; Introduction to the Emulsion (Emulsion Nyumon) (1970), Soichi Muroi; Introduction to the Polymer Latex (Polymer Latex Nyumon) (1970), Takuhiko Motoyama; Vinyl Emulsion (1965), Mike Shider Juang et al.; Journal of Polymer Science, Polymer Chemistry Edition 14 2089~2107 (1976).

Conditions of the synthesis of a cationic polymer, such as polymerization initiator, concentration, polymerization temperature and reaction period, can be changed easily. The extent of the change of above described conditions may be broad in relation to the purpose of the synthesis.

Some hydrophilic colloids which act as binders for cationic polymers are gelatin, casein, agar, polyvinylalcohol and polyacrylamide, but the best one in this invention is gelatin. We can use any kind of gelatin that is already known. For example, gelatins made by different processes can be used, such as lime-processed gelatin, acid-processed gelatin, or chemically denaturated gelatins thereof (such as those which are phthalated or sulfonilated). Moreover, these gelatins may be used after a desalting process.

A person skilled in the art can easily determine the mixing ratio of cationic polymer and binder which is used in this invention as well as the quantity of polymer to be applied, considering several factors such as a composition of silver halide in a photographic material, an application quantity thereof, a kind of polymer, a composition of polymer, a process which is used to form image. Accordingly, the weight ratio of (polymer/binder) can be chosen from the range between 20/80~80/20; on the other hand, the application quantity can be chosen from the range between 0.01~8 g/m$^2$ and preferably between 0.1~2 g/m$^2$.

The examples of cationic polymers which are used in this invention are shown below:

(1)

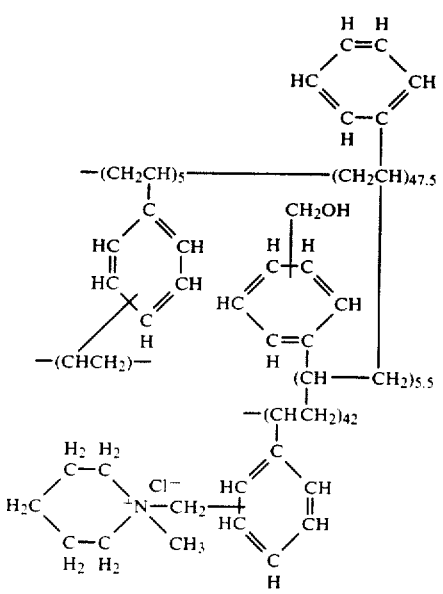

-continued (2)

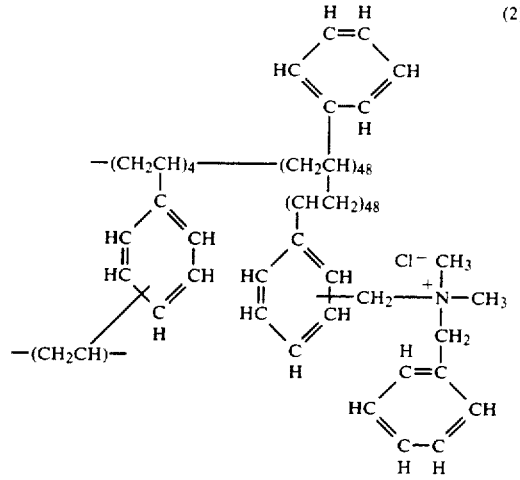

(3)

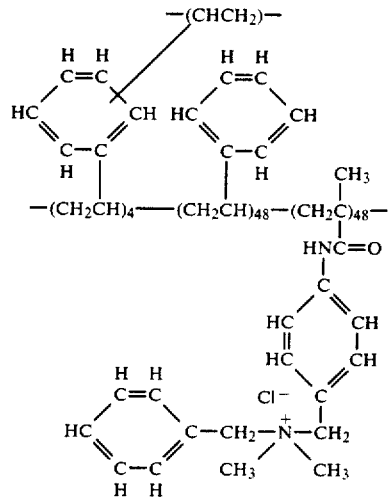

(4)

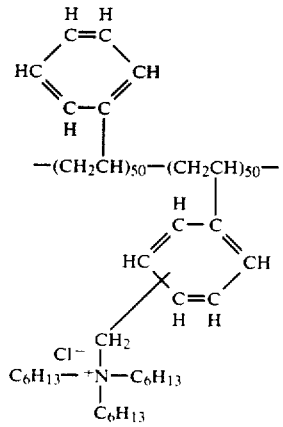

-continued (5)

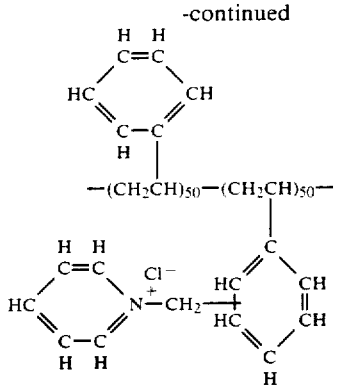

(6)

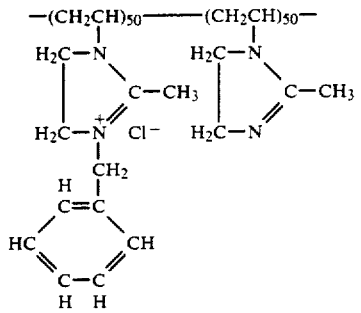

(7)

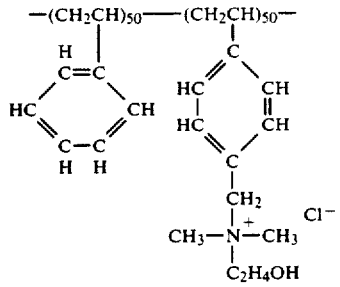

The developing intensifying process is usually carried out at the temperature between 18° C.~50° C. in this invention, but the temperature may not be restricted at that range. The PH of the developing intensifying solution is between 7~14, but the range between 8~13 is preferable.

In the developing intensifying solution, known compounds which may compose developing solution can also be contained. For example, the following compoumds are used as alkali reagent or buffer reagent: caustic soda, potassium carbonate, sodium quinolinate, potassium quinolinate, dipotassium hydrogenphosphate, disodium hydrogenphosphate, sodium phosphate, potassium phosphate, phosphoric acid, sodium pyrophosphate, potassium pyrophosphate, potassium metaborate, sodium metaborate and borax.

In this invention the following compounds may preferably be used as a stabilyzer of peroxide: compounds which are described in "Hydrogen Peroxide" 515~547, written by W. C. Schumb et al., or described in *Research Disclosure* 11660; organic phosphonate compounds which are described in Japanese Patent Application-OPI Nos. 10,523/77, 127,555/80; polyphosphoric compounds such as sodium hexametaphosphate, sodium tetrapolyphosphate, potassium solts thereof; aminopolycarboxylates such as ethylenediamine tetra acetate, nitrotriacetate, triethylene tetra amine hexa acetate, iminodiacetate, hydroxyethyl iminodiacetate, N-hydroxymethyl ethylenediamine triacetate, hydroxyethyl ethylenediamine triacetate, diethylene triamine penta acetate, cyclohexane diamine tetra acetate and diaminopropanol tetra acetate. More than two species of above described compounds may be used at the same time. These compounds are also known as water softeners and they may be used in that way. The descriptions about these water softeners can be found in previous works such as reports written by J. W. Willeres which were opened in "Belgisches Chemiches Industry" 21, 325 (1956), ibid. 23, 11505 (1958) and also found in U.S. Pat. No. 4,083,723.

A developing accelerator can be added to the developing intensifying solution, if necessary. For example, various pyridium compounds and the other cationic compounds, cationic dyes such as phenosafranine, and neutral salts such as thallium nitrate or potassium nitrate as described in prior arts such as U.S. Pat. Nos. 2,648,604, 3,671,247 and Japanese patent publication No. 9,503/69, polyethyleneglycols and derivatives thereof, a nonionic compound such as polythioethers as described in U.S. Pat. Nos. 2,533,990, 2,531,832, 2,950,970, 2,577,127 and Japanese patent publication No. 9,504/69, organic solvents and oragnic amines as described in Japanese patent publication No. 9,509/69 and Belgian Patent No. 682,862, the accelerating agent as described in L. F. A. Mason, "Photographic Processing Chemistry" pages 40~43 (Focal Press, London 1966), benzyl alcohol and phenylethyl alcohol as described in U.S. Pat. No. 2,515,147, pyridine, ammonia, hydrozine and amines as described in "Nippon Shashin Gakkaishi", Vol. 14, page 74 (1952) can be added.

There can also be added hydroxylamine sulfate and hydroxylamine hydrochloride, sodium sulfite, potassium sulfite, potassium disulfite and sodium disulfite to the developing intensifying solution.

Moreover, the following chemicals can also be added to the developing intensifying solution, if necessary: competing couplers (e.g., citrazinic acid, J acid, H acid), some of them are described in Japanese patent application Nos. 508/69, 9,505/69, 9,506/69, 9,507/69, 14,036/70, and in U.S. Pat. Nos. 2,742,832, 3,520,690, 3,560,212, 2,645,737; fogging agents (e.g., alkalimetal borohydride, aminoborane, ethylene diamine) which are described in, for example, Japanese patent publication No. 38,816/72; supplementary developers (e.g., p-aminophenol, benzil-p-aminophenol, 1-phenyl-3-pyrazolidon), which were disclosed in Japanese patent publication Nos. 41,475/70, 19,037/71, 19,438/71.

Color developing agents used in this invention include p-phenylenediamine derivatives, onium salt type p-aminophenol derivatives disclosed in U.S. Pat. No. 3,791,827 etc., dye developing agents as described in U.S. Pat. No. 2,983,606, diffusible dye releasing type (DDR) redox compounds described in Japanese Patent Application-OPI No. 33,826/73, developing agents capable of reacting with an amidorazone compound, reducing agents that are oxidized to form a dye or lakes (such as tetrazonium salt, 2,4-diaminophenol, α-nitroso-β-naphthol-leuco dyes) as disclosed in Japanese patent publication No. 39,165/73 and the other reducing agents capable of forming a colored image after oxidation as disclosed in Japanese Patent Application-OPI No. 6,338/72 on pages 9~13. The reducing agents which act as developing agents can be classified from the view point of forming a color image.

Namely, some reducing agents are self-oxidized to couple with a color-coupler, some reducing agents are self-oxidized to form dyes, and the other reducing agents are previously colored and are oxidized to form non-diffusible dye.

Preferred examples of p-phenylenediamine derivative color developing agents include 2-amino-5-diethylaminotoluene hydrochloride, 2-amino-5-(N-ethyl-N-laurylamino)toluene, 4-(N-ethyl-N-(β-hydroxyethyl-)amino)aniline sulfate, 2-methyl-4-(N-ethyl-N-(β-hydroxyethyl)amino)aniline sulfate, N-ethyl-N-(β-methanesulfonamidoethyl)-3-methyl-4-aminoanilinesesquisulfatemonohydrate described in U.S. Pat. No. 2,193,015, N-(2-amino-5-diethylaminophenylethyl)methanesulfonamide sulfate and N,N-dimethyl-p-phenylenediamine hydrochloride described in U.S. Pat. No. 2,592,364, 4-amino-3-methyl-N-ethyl-N-methoxyethylaniline, 4-amino-3-methyl-N-ethyl-N-ethyl-N-β-ethoxyethylaniline and 4-amino-3-methyl-N-ethyl-N-β-butoxyethylaniline and the salt thereof (such as sulfate, hydrochloride, sulfite, p-toluenesulfonate) described in U.S. Pat. Nos. 3,656,950 and 3,698,525.

In addition to the above, color developing agents described in F. A. Mason "Photographic Processing Chemistry" (Focal Press, 1966), pages 226~229 can be used.

There are basically two types of reducing agents. In one type, the reducing agents themselves form dye images by oxidation. In the other type, the agents form complex salts with metal. Examples of agents which belong to the latter type are the developing agents described in British Patent No. 1,210,417, tetrazonium salt described in U.S. Pat. No. 3,655,382, 2,4-diaminophenol and α-nitroso-β-naphthol. These reducing agents are oxidized by peroxides in the presence of a catalytic material, but are oxidized at an excessively low speed in the absence of a catalytic material. Those reducing agents themselves may be image-forming elements or oxidation products thereof may form images by reacting with color couplers.

Generally, photographic materials for camera work contain silver salts in an amount of 3~10 g/m$^2$ calculated in terms of silver, and for print use it is in an amount of 1~4 g/m$^2$. The photographic materials used in this invention contain silver less than 1 g/m$^2$ and preferably less than 0.5 g/m$^2$. In the multilayer photographic materials, each light-sensitive layer contains less than 1 g/m$^2$ of silver and particularly between 0.5 g/m$^2$ and 1 mg/m$^2$.

The color former used in this invention is the type of compound that reacts with the oxidized color developing agents to form dyes (i.e., a coupler).

Couplers used in this invention include dye-forming couplers as hereinafter described. More specifically, those couplers include couplers capable of forming dyes by the oxidation coupling of an aromatic primary amine developing agent (such as phenylenediamine derivatives and aminophenol derivatives) in a color development. Specific examples of magenta couplers include 5-pyrazolones coupler, pyrazolobenzimidazole coupler, cyanoacetylcoumarone coupler, and openchained acylacetonitrile coupler. Examples of yellow couplers include acylacetoamide couplers (for example, benzoylacetoanilides, pivaloylacetoanilides), and examples of cyan couplers include naphthol couplers and phenol couplers. Preferred couplers are non-diffusible ones having a hydrophobic group called a ballast group or polymerized couplers. Color couplers may be a 4-equivalent type or a 2-equivalent type with respect to silver ions. Colored couplers having the color adjusting effect or development inhibitor releasing couplers (DIR couplers) are also acceptable.

In addition, it is possible to contain colorless DIR coupling compounds which form colorless coupling products.

More than two species of the above mentioned chemicals, including couplers, can be incorporated into a layer, or one of the chemicals can be incorporated into two or more layers at the same time, in order to satisfy the required photographic properties.

A method of introducing couplers into silver halide photographic layers was disclosed, for example, in U.S. Pat. No. 2,322,027. For example, the couplers may be dissolved in organic solvents having a high boiling point, e.g., an alkyl phthalate (e.g., dibutyl phthalate or dioctyl phthalate), phosphoric acid ester (e.g., diphenyl phosphate, triphenyl phosphate, tricresyl phosphate or dioctylbutyl phosphate), citric acid ester (e.g., tributylacetylcitrate), benzoic acid ester (e.g., octyl benzoate), alkylamide (e.g., diethyllauryl amide), fattyacid esters (e.g., dibutoxyethyl succinate, diethyl azelate), trimesic acid esters (e.g., tributyl trimesate). The couplers may also be dissolved in organic solvents having a boiling point of from 30° to 150° C., e.g., lower alkyl acetate such as ethyl acetate or butyl acetate, ethyl propyonate, secondary butyl alcohol, methyl isobutyl ketone, β-ethoxyethyl acetate, methyl cellosolve acetate. Then the couplers are dispersed into a hydrophilic colloid. The above mentioned high boiling point solvents are low boiling point solvents can be mixed together.

A dispersing method using polymers as disclosed in Japanese patent publication No. 39,853/76 and in Japanese Patent Application-OPI No. 59,943/76 can also be used in this invention.

When a coupler has acid groups (e.g., carboxylic acid and sulfonic acid), they are introduced into a hydrophilic colloid in the form of an aqueous alkaline solution.

A photographic color coupler is preferably selected so as to give an intermediate scale image. It is preferable that the maximum absorption range of a cyan dye which is formed from a cyan coupler is between 600 and 720 nm, the maximum absorption range of a magenta dye which is formed from a magenta coupler is between 500 and 580 nm and the maximum absorption range of a yellow dye which is formed from a yellow coupler is between 400 and 480 nm.

A silver halide emulsion is usually prepared by mixing an aqueous solution of a water-soluble silver salt (e.g., silver nitrate) and an aqueous solution of a water-soluble halogen salt (e.g., potassium bromide) in the presence of an aqueous solution of a water-soluble polymer such as gelatin. Useful silver halide include not only silver chloride and silver bromide, but also a mixed silver halide such as silver chlorobromide, silver iodobromide and silver iodochlorobromide. The average particle size (when the particle is in the form of a ball or ball-like, the particle size means a diameter of a particle, and when the particle is in the form of cubic, the particle size means an edge of a particle, i.e., an average size of a projected area) is preferably lower than 2μ and the most preferable size is lower than 0.4μ. The distribution range of a particle size may be narrow or wide.

The structure of silver halide particles may be either a cubic crystal, an octahedron, or a mixture thereof.

As for the crystal structure, a silver halide particle may be homogeneous from inside to outside of it, but it may be in a layered structure—both sides of which are different each other. A silver halide particle, what is called conversion type, disclosed in British Pat. No. 635,841 and in U.S. Pat. No. 3,622,318, is also acceptable. One type of silver halide particle may form the latent image on the surface but another type of one may form it inside of the particle. These photographic emulsions are described and recognized in C. E. K., Mees, "The Theory of Photographic Process" published by MacMillan, in P. Grafkides, "Chimie Photographique" published by Paul Montel (1957).

The emulsions may be prepared by the method described in P. Grafkides, "Chimie et Physique Photographique" published by Paul Montel (1967), in G. F. Duffin, "Photographic Emulsion Chemistry" published by the Focal Press (1966)

and in V. L. Zelikman et al., "Making and Coating Photographic Emulsion" published by the Focal Press (1964).

Namely it may be an acid method, a neutral method or an ammonium method. As a method for reacting a soluble silver salt with a soluble halogen salt, a single jet method, a double jet method and a mixture of these methods may be used. A method for forming silver halide particles under the excess of silver ion (so-called reverse mixing method) can also be used. One type of useful double jet method is the so-called "controlled double jet method" wherein PAg, in liquid phase, is kept constant and silver halide is formed. By this method, a silver halide emulsion with a regular crystal is formed and a nearly uniform crystalsize can be obtained.

More than two types of silver halide emulsion prepared separately may be mixed together.

In the process of forming silver halide particles or of physical ripening, a cadmium salt, a zinc salt, a lead salt, a talium salt, a iridium salt, a complex salt thereof, a rhodium salt or a complex salt thereof, a ferric salt or a complex salt thereof may be co-present.

Soluble salts are usually removed from the emulsion after precipitates are formed or after the physical ripening is completed. As a removal means, a known noodle washing method for gelation of gelatin can be employed. A flocculation method utilizing chemicals, such as inorganic salts consisting of polyvalent anions (e.g., sodium sulfate), an anionic surfactant, an anionic polymer (e.g., polystyrene sulfonate), a gelatin derivative (e.g., an aliphatic acylated gelatin, an aromatic acylated gelatin or aromatic carbamoylated gelatin), can also be employed. The step of removing soluble salts may be omitted.

Generally, the silver halide emulsion is chemically sensitized, but a primitive emulsion which is prepared without chemical sensitization can also be used. Methods of chemical sensitization described in books written by Grafkides or by Zelikman, which are mentioned previously, or in H. Frieser, "Die Grundlagen der Photographischen Prozesse mit Silberhalogeniden" (Akademische Verlagsgesellschaft, 1968) can be applied to the silver halide emulsion. In some cases, various additives are preferably incorporated into photographic materials to obtain desirable developing properties, image characteristics and physical properties of layers. Such additives include iodide compounds in the form of salts, organic compounds having mercapto free radical (e.g., phenylmercaptotetrazole) and alkali metal iodides. It is preferable that these compounds are used in a small amount.

In order to improve properties (e.g., sensitivity, contrast, development), a polyalkyleneoxide, ethers, esters and amines thereof, thioether compounds, thiomorpholines, quaternary ammonium salt compounds, urethane derivatives, ureido derivatives, imidazole derivatives and 3-pyrazolidones can be incorporated into the photographic material.

In the photographic material which is used in this invention, supplemental developing agents may be added. The preferable examples of above supplemental developing agents are as follows: hydroquinone, alkyl substituted hydroquinones (e.g., t-butyl-hydroquinone, 2,5-dimethylhydroquinone), catechols, pyrogallols, halogen substituted hydroquinones (e.g., chlorohydroquinone, dichlorohydroquinone), alkoxyhydroquinones (e.g., methoxyhydroquinone), polyhydroxybenzene derivatives (e.g., methylhydroxynaphthalene). Compounds, such as methyl gallate, ascorbic acid, ascorbic acid derivatives, hydroxylamines (e.g., N,N'-di-(2-ethoxyethyl)hydroxylamine), pyrazolidones (e.g., 1-phenyl-3-pyrazolidone, 4-methyl-4-hydroxymethyl-1-phenyl-3-pyrazolidone), reductones and hydroxytetronic acids are also useful.

Preferred examples of anti-foggants which are usually incorporated into a photographic silver halide emulsion layer and a light insensitive auxiliary layer, are heterocyclic organic compounds such as tetrazoles, azaindenes, triazoles or aminopurine.

Other additives which can be incorporated into the photographic materials include a hardening agent, a plasticizer, a lubricant, a surface agent, a gloss agent and other additives known in the photographic fields.

A binder or a protective colloid is preferably gelatin but a hydrophilic colloid can also be used. For example, proteins, such as, gelatin derivatives, a grafted polymer of gelatin with other polymers, albumin and casein; polysaccharides, such as cellulose derivatives (e.g., hydroxyethylcellulose, carboxymethylcellulose or cellulose sulfate), sodium alginate, or starch derivatives; various synthesized hydrophilic polymers such as polyvinylalcohol, polyvinyl alcohol partially acetal, poly-N-vinylpyrrolidone, polyacrylic acid, polymethacrylic acid, polyacrylamide, polyvinylimidazole, polyvinylpyrazole or copolymers thereof can be used.

Examples of gelatins which are used in this invention include lime-processed gelatin, acid-processed gelatin, and enzyme-processed gelatin which is described in Bull. Soc. Sci. Phot. Japan, No. 16, page 30 (1966). Hydrolysis products or enzyme-decomposed products of gelatin can also be used instead of gelatin. Examples of gelatin derivatives include reaction products of gelatin with other various compounds such as an acid halide, an acid anhydride, isocyanates, a bromoacetate, alkanesultones, vinylsulfone amides, maleimides, polyalkyleneoxides or epoxy compounds.

Examples of the above mentioned grafted gelatin include gelatins grafted with homo- or copolymers which are derived from monomers selected from vinylseries monomers such as acrylic acid, methacrylic acid, ester derivatives thereof and amide derivatives thereof, acrylonitrile and styrene. Particularly, polymers which have some compatibility with gelatin are preferably grafted to gelatin—some of these polymers can be derived from monomers, such as acrylic acid, methacrylic acid, acrylamide, methacrylamide or hydroxyalkylmethacrylate.

Typical examples of synthesized hydrophilic polymers are described in German Patent Application (OLS) No. 2,312,708, in U.S. Pat. Nos. 3,620,751, 3,879,205 and in Japanese patent publication No. 7,561/68.

A photographic emulsion can, if necessary, be spectrally sensitized by at least one dye selected from cyanine dyes such as cyanine, merocyanine or carbocyanine. Other dyes, such as styryl dyes, may be added to the above cyanine dyes.

A photographic material which is used in this invention has at least one layer of the silver halide emulsion on a support. Usually, it has a red-sensitive silver halide emulsion layer, a green-sensitive silver halide emulsion layer and also has a blue-sensitive silver halide emulsion layer on the support. In some cases, it has a red-sensitive silver halide emulsion layer containing a cyan image forming coupler, a green-sensitive silver halide emulsion layer containing a magenta image forming coupler and a blue-sensitive silver halide emulsion layer containing a yellow image forming coupler on the support.

A hydrophilic colloidal layer of photographic material may have a water soluble dye as a filter dye or for various other purposes, for example, for the prevention of irradiation. Examples of above water soluble dyes include an oxonole dye, a hemi-oxonole dye, a styryl dye, a merocyanine dye, a cyanine dye and an azo dye. In these dyes the oxonole dye, the hemi-oxonole dye and the merocyanine dye are preferable.

The photographic material may contain an ultraviolet absorbing agent in a hydrophilic colloidal layer. For example, benzotriazoles substituted with an aryl group, 4-thiazolidone compounds, benzophenone compounds, cinnamic ester compounds, butadienen compounds, benzoxazole compounds and ultraviolet absorbing polymers can be employed.

The above described ultraviolet absorbing agent may be fixed in the hydrophilic colloidal layer.

The photographic material may contain whitening agents such as those of stylbene series, triazine series, oxazole series or cumarine series in a photographic emulsion layer or in other hydrophilic colloidal layers. These agents may be water soluble or water insoluble. However when they are water insoluble, they are employed in the dispersing form.

When agents, such as dyes, ultraviolet absorbing agents are included in a hydrophilic colloidal layer of photographic material, they may be fixed in cationic polymers by means of a mordant.

The photographic material may contain color-antifoggants, such as hydroquinone derivatives, aminophenol derivatives, gallic acid derivatives and ascorbic acid derivatives.

In this invention, a known fade-preventing agent, such as hydroquinone derivatives, gallic acid derivatives, p-alkoxy-phenols, p-oxyphenol derivatives and bisphenols can be used. A color image stabilizer can also be used.

More than two species of stabilizers may be employed together.

In photographic emulsion layers and other hydrophilic colloidal layers of photographic material which is used in this invention may contain various surfactants for purposes, such as coating aid, anti-static, slippery improvement, emulsification dispersion, adhesive protection and improvement of photographic properties (e.g., acceleration of development, increase of high contrast, sensitization).

Examples of useful surfactants include nonionic surfactants such as saponine (steroid series), alkylene oxide derivatives (e.g., polyethylene glycol, polyethylene glycol/polypropylene glycol condensate, polyethylene glycol alkyl ethers, polyethylene glycol alkyl aryl ethers, polyethylene glycol esters, polyethylene glycol sorbitan esters, polyalkylene glycol alkylamines, polyalkylene glycol alkylamides, polyethylene oxide adducts of silicone), glycidol derivatives (e.g., an alkenyl succinic acid polyglyceride, an alkylphenol polyglyceride), a fatty acid esters of polyhdric alcohols or an alkyl esters of saccharide; anionic surfactants having at least an acid group such as a carboxyl group, a sulfo group, a phospho group, a sulfuric ester group or a phosphoric ester group (e.g., an alkyl carboxylate, an alkyl sulfonate, an alkyl benzene sulfonate, an alkyl naphthalene sulfonate, alkyl sulfates, alkyl phosphates, N-acyl-N-alkyltaurates, sulfosuccinates, sulfoalkyl-polyoxyethylene-alkylphenyl ethers, polyoxyethylene alkylphosphates); amphoteric surfactants such as amino acids, aminoalkyl sulfonates, aminoalkyl sulfates, aminoalkyl phosphates, alkyl betaines or amineoxides; and cationic surfactants such as alkylamines, aliphatic or aromatic quaternary ammonium salts, heterocyclic quaternary ammonium salts (e.g., pyridinium, imidazolium), aliphatic phosphonium salts, aliphatic sulfonium salts and phosphonium- or sulfonium salts containing a hetero ring.

Photographic emulsion layers and/or other hydrophilic colloidal layers of photographic material may include an inorganic or an organic hardening agent. Some of hardening agents may be selected from compounds such as chromium salts (e.g., chromium alum, chromium acetate), aldehydes (e.g., formaldehyde, glyoxal, glutaraldehyde), N-methylols (e.g., dimethylolurea, methylol dimethylhidantoin), dioxanederivatives (e.g., 2,3-dihidroxydioxane), active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), and mucohalogen acids (e.g., mucochloric acid, mucophenoxychloric acid). More than two species of these compounds may be employed together.

In the photographic emulsion layer and/or other hydrophilic colloidal layers of the photographic material which is used in this invention, dispersions of polymers which are insoluble or hardly soluble in water may be contained, for purposes such as improvement of dimensional stability. Some polymers which may be used in above dispersion can be derived from monomers such as an alkyl acrylate, an alkyl methacrylate, an alkoxyalkyl acrylate, an alkoxyalkyl methacrylate, glycidyl acrylate, glycidyl methacrylate, acrylamide, methacrylamide, vinylesters (e.g., vinylacetate), acrylonitrile, olefines or styrenes. These monomers can also copolymerize with each other. Moreover, above monomers may copolymerize with monomers such as acrylic acid, methacrylic acid, an $\alpha,\beta$-unsaturated dicarboxylic acid, a hydroxyalkyl acrylate, a hydroxyalkyl methacrylate, a sulfoalkyl acrylate, a sulfoalkyl acrylate, a sulfoalkyl methacrylate and styrenesulfonic acid.

This invention can also be applied to a multi layered color photographic material which has at least two layers (spectral sensitivities of each layer are different from each other) on a support. The multi layered color photographic material is usually comprised, at least, of a red-sensitive emulsion layer, a green-sensitive emulsion layer and a blue-sensitive emulsion layer. The order of the layers can be optionally determined. In general, the red-sensitive emulsion layer contains a cyan forming coupler, the green-sensitive emulsion layer contains a magenta forming coupler, and the blue-sensitive emulsion layer contains a yellow forming coupler. In some cases, the combination of the layer and the coupler is different from the above.

Some photographic supports which are used in this invention include cellulose nitrate film, cellulose acetate film, cellulose acetate butylate film, cellulose acetate propionate film, polystyrene film, polyethylene terephthalate film, polycarbonate film and the laminated film thereof, thin glass, paper, etc. These supports usually used for a photographic material. Baryta paper and papers coated with or laminated with an $\alpha$-olefinpolymerized polymer (especially polymers of $\alpha$-olefin having 2 to 10 carbon atoms; e.g. polyethylene, polypropylene, ethylenebutane copolymer), and a plastic film with a roughened surface are preferable. Plastic films with roughened surfaces are described in Japanese patent publication No. 19,068/72—these surfaces have improved adhesion with other polymers.

One of the typical procedure of this invention is comprised of (1) an exposure process of color photographic material, (2) a developing intensifying process, (3) a fixing or a fixing process after bleaching, (4) a washing and (5) a drying. Although color images may be obtained by this procedure, it is possible to omit the process (3) and the washing process may be replaced by a stabilization process.

In an another typical process of this invention, couplers may be contained in the developing intensifying solution. In this case outside type couplers (so-called diffusible outside type coupler) are used in an amount of 0.5~5 g/l, but the range 1~2.5 g/l is preferable. These couplers were disclosed in previous works; some cyan couplers were described in U.S. Pat. Nos. 3,002,836 and 3,542,552, some magenta couplers were described in Japanese patent publication No. 13,111/69 and some yellow couplers are described in U.S. Pat. No. 3,510,306.

An imagewise exposure for photographic image can be carried out in an ordinary way. Namely, any well-known light source, e.g., natural light (sunlight), tungsten lamp, fluorescent lamp, mercury lamp, xenon arc lamp, carbon arc lamp, xenon flash lamp or flying spot on cathode ray tube can be used. An exposure time may be 1/1000 to 1 second (this time range is usual for camera work), but shorter time than 1/1000 second (e.g., It may be from $1/10^4$ to $1/10^6$ second when xenon flash lamp or cathode ray tube is used.) and longer time than 1 second are also possible. If necessary, spectral composition of exposing light can be controlled by employing a color filter. Laser light and stimulated emission from a fluorescent substance (excited by electron beam, X-ray, $\gamma$-ray or $\alpha$-ray) may also be used.

EXAMPLES

The following examples are set forth for the purpose of illustration so that those skilled in the art may better understand this invention. It should be understood that they are exemplary only, and should not be construed as limiting the invention in any manner.

EXAMPLE 1

The photographic material was prepared as follows. A paper support was laminated on both sides with a polyethylene, (which had titanium dioxide dispersed in the polyethylene), was coated with a first layer and then recoated with a second layer. The following explanation describe the photographic material in detail.

| | |
|---|---|
| Second layer | gelatin (1000 mg/m$^2$) |
| First layer | |
| (a) silver chlorobromide emulsion; (silver bromide 70 mole %, silver 10 mg/m$^2$, average particle size 0.4$\mu$) | |
| (b) gelatin; (1000 mg/m$^2$) | |
| (c) cyan coupler dispersed in phthalic acid-n-butylester; 2-[$\alpha$-(2,4-di-t-amylphenoxy) butaneamide ]-4,6-dichloro-5-methylphenol (1000 mg/m$^2$) | |
| (d) anti-foggant; 1-phenyl-5-mercaptotetrazol (compound No. 49 in this description) ($3.7 \times 10^{-7}$ mole/m$^2$) | |
| Paper Support: both surfaces were laminated with polyethylene dispersing $TiO_2$ in it | |

Obtained samples were exposed by a sensitometer and were processed as follows:

| Processing step | temperature (°C.) | period (min.) |
|---|---|---|
| monobath developing intensifying process | 35 | 1 |
| fixing process | 25~40 | 1 |
| washing process | 25~40 | 5 |

The above monobath developing intensifying solution and fixing solution were as follows:

monobath developing intensifying solution;
potassium sulfite: 4 g
potassium phosphate: 40 g
dipotassium hydrogenphosphate: 6 g
1-hydroxyethane-1,1-diphosphonic acid: 2 g
4-amino-3-methyl-N-ethyl-N-$\beta$-(methane sulfonamide)ethylaniline 3/2 sulfate monohydrate: 4 g
hydrogen peroxide ($H_2O_2$ 30%) 20 ml
add water: to make a 1 l solution with a PH of 11.0.
fixing solution;
ammonium thiosulfate: 150 g
sodium sulfite: 10 g
sodium hydrogen sulfite: 2.5 g
add water: to make a 1 l solution with a PH of 6.0.

(A) is defined as the process in which the utilized quantity of the developing intensifying solution was 50 l/m and it was 0.7 l/m$^2$ in the process (B). The cyan density of the image obtained in each process is shown in table 1.

TABLE 1

| process | fog | Maximum density |
|---|---|---|
| [A] | 0.12 | 2.52 |
| [B] | 0.28 | 1.78 |

From these results it is obvious that the maximum density decreases and fog increases, when only small amounts of the developing intensifying solution are used in the process.

In the (B) process, the developing intensifying solution was circulated by a mini-pump and was agitated during the thin layer process. Moreover, a bleaching process was omitted. Since the silver amount in the sample is small, the image density of the silver hardly affects the final image density.

EXAMPLE 2

Same samples which were used in EXAMPLE 1 were exposed to the sensitometer. Processing solutions and processing steps utilized in this EXAMPLE were just the same to those used in EXAMPLE 1. The thin layer process was carried out with 0.7 l/m$^2$ of developing intensifying solution which had been in contacted with the anion exchanger during the process. The cyan density of the image obtained by above process was measured by the densitometer. The results are shown in table 2, and are compared with the result obtained when an anion exchanger was not employed.

| Exp. No. | Anion-Exchanger (E) | Quantity of (E) per 1 l of D.I.S. |
|---|---|---|
| 1 | none | |
| 2 | Amberlite IRA-400 (OH-type) (made by ORUGANO Co., Ltd.) | 20 g |
| 3 | DIAION PA-318 (OH-type) (made by MITSUBISH KASEI KOGYO Co., Ltd) | 20 g |
| 4 | Duolite A-101D (OH-type) (made by SUMITOMO KAGAKU KOGYO Co., Ltd) | 20 g |

In the above table, D.I.S. means the "developing intensifying solution".

TABLE 2

| Exp. No. | fog | Maximum density |
|---|---|---|
| 1 | 0.28 | 1.78 |
| 2 | 0.15 | 2.18 |
| 3 | 0.15 | 2.16 |
| 4 | 0.16 | 2.20 |

The results table 2 illustrate that fog decreases but maximum density increases, when the image is obtained by a process in which the developing intensefying solution contacts an anion exchanger.

EXAMPLE 3

The photographic material was prepared as follows. A paper support was laminated on both sides with a polyethylene, (which had titanium dioxide dispersed in the polyethylene), was coated with a first layer and then recoated with a second layer. The following explanation describe the photographic material in detail.

Second layer gelatin (1000 mg/m$^2$)

First layer (a) silver chlorobromide emulsion; (silver bromide 70 mole %, silver 10 mg/m$^2$, average particle size 0.4$\mu$ (b) gelatin; (1000 mg/m$^2$)

(c) cyan coupler dispersed in phthalic acid-n-butylester; 2-[$\alpha$-(2,4-di-t-amylphenoxy) butaneamide ]-4,6-dichloro-5-methylphenol (1000 mg/m$^2$)

(d) anti-foggant: 5-methylbenzotriazol (compound No. 3 in this description) ($0.93 \times 10^{-5}$ mole /m$^2$)

Paper Support: both surfaces were laminated with polyethylene dispersing $TiO_2$ in it In some samples, cationic polymers described in this description were added in second layers:

| sample No. | cationic polymer | amounts to be added |
|---|---|---|
| 1 | none | |
| 2 | compound No. 1 | 1 g/m$^2$ |
| 3 | compound No. 2 | 1 g/m$^2$ |
| 4 | compound No. 5 | 1 g/m$^2$ |

When these samples were processed in the same way as in EXAMPLE 1, cyan images were obtained. In each process 0.7 l/m$^2$ of developing intensifying solution was used. The densities of the obtained images were measured and the results are shown in table 3.

TABLE 3

| sample No. | fog | maximum density |
|---|---|---|
| 1 | 0.28 | 1.78 |
| 2 | 0.14 | 2.20 |
| 3 | 0.14 | 2.18 |
| 4 | 0.15 | 2.14 |

These results illustrate the fact that fog decreases but maximum density increases when a cationic polymer is contained in the photographic material.

EXAMPLE 4

The same samples to No. 1~No. 4 in EXAMPLE 3 were processed in the same way as in EXAMPLE 1. In each case 0.7 l/m$^2$ of developing intensifying solution was used. This solution was in contact with 10 g of an anion exchanger—DIAION PA-318 (OH-type)—during the thin layer process which was the same process carried out in EXAMPLE 1. Densities of obtained cyan images have been measured and the results are shown in table 4.

TABLE 4

| sample No. | fog | maximum density |
|---|---|---|
| 1 | 0.15 | 2.16 |
| 2 | 0.12 | 2.42 |
| 3 | 0.12 | 2.40 |
| 4 | 0.12 | 2.35 |

These results illustrate that when the photographic material containing a cationic polymer is processed with a small amount of developing intensifying solution, which is in contact with an anion exchanger, a high density image with little flg is obtainable.

What is claimed is:

1. In the method to form color image which uses a low silver containing photographic material, in which the photographic material is developed in the presence of nitrogen containing heterocyclic compounds using a monobath developing intensifying solution, which contains substantially neither $Br^-$ nor $I^-$ ions, but contains both $H_2O_2$ or compounds which can release $H_2O_2$ and color developing agents; the improved method to form color image which is characterized by the process that the monobath developing intensifying process is carried out in the presence of an anion exchange resin.

2. The method to form color image as in claim 1, wherein said anion exchange resin is a strong base type anion exchange resin.

3. The method to form color image as in claim 2, wherein said anion exchange resin is founded on polystyrene or on polystyrene-divinyl benzene copolymer, and has a dimethylethanolammonium group or a trimethylammonium group as an active exchange group.

4. The method to form color image as in claim 1, wherein said anion exchange resin is used in an amount of 1-500 g per 1 l of developing intensifying solution.

* * * * *